US005319903A

United States Patent [19]

Holland

[11] Patent Number: 5,319,903

[45] Date of Patent: Jun. 14, 1994

[54] PREFABRICATED MODULAR CLOSET UNIT

[76] Inventor: Phillip R. Holland, P.O. Box 44, Pleasant View, Tenn. 37146

[21] Appl. No.: 532,584

[22] Filed: Jun. 4, 1990

[51] Int. Cl.[5] ..... A47G 29/02

[52] U.S. Cl. ..... 52/79.1; 52/79.9

[58] Field of Search ..... 52/79.1, 36, 34, 35, 52/79.4, 79.5, 79.9, 79.12; 312/111, 208

[56] References Cited

U.S. PATENT DOCUMENTS 3,162,863 12/1964 Wokas ..... 52/79.1 X
4,077,686 3/1978 Bukaitz .
4,238,858 12/1980 Maihart ..... 52/79.1 X
4,553,276 11/1985 Paradis ..... 52/79.1 X
4,788,802 12/1988 Wokas ..... 52/79.1 X
4,998,388 3/1991 Englehart ..... 52/79.1

*Primary Examiner*—Carl D. Friedman
*Assistant Examiner*—Robert J. Canfield
*Attorney, Agent, or Firm*—Woodard, Emhardt, Naughton, Moriarty & McNett

[57] ABSTRACT

A prefabricated modular closet comprising a base, an integral enclosure having sidewalls, a back wall, a front wall with an opening therein, and a ceiling, and furring attached to the exterior surface of the enclosure.

9 Claims, 5 Drawing Sheets

PREFABRICATED MODULAR CLOSET UNIT

BACKGROUND OF THE INVENTION

This invention pertains to a prefabricated modular closet, and more particularly, to a closet construction which is prefabricated at one location and installed at a building site.

In constructing new buildings, building additions to existing structures, and remodeling interior rooms of existing structures, the process of building closets requires the labor of a number of trades. These trades include a framer, an electrician, a dry waller, a dry wall finisher, a trim man, a painter, and a carpet installer. In a conventional closet construction, wood studs frame the closet. Electrical wire is installed inside the wood framing. Dry wall is affixed to the framing to form the interior and exterior surface of the closet. The dry wall is then finished and painted. Finally, the carpet is installed in the closet. The process of coordinating and scheduling skilled persons to perform these function is both time consuming and expensive as all the persons are typically skilled craftsmen.

In the past various means have been developed to facilitate more efficient and less expensive means of providing closets. U.S. Pat. No. 4,223,967 issued Sep. 23, 1980 to Royer discloses one such modular closet unit. The '967 patent consist of prefabricated floor, ceiling and wall units which are assembled together in situ and form the walls of the enclosure with external frames forming a backing adapted to receive standard wall panels. The floor, ceiling and wall units are secured together by means of a special clip. U.S. Pat. No. 4,371,221 issued Feb. 1, 1983 to Citterio discloses a composite modular element structure for furnishings. The '221 patent does not disclose a prefabricated modular closet of the present invention. U.S. Pat. No. 3,585,767 issued Jun. 22, 1971 to Lindingo et al. discloses a prefabricated room unit.

BRIEF SUMMARY OF THE INVENTION

This invention set out to present an efficient and economical means for providing a closet construction.

With this general aim, it is a basic object of this invention to provide a modular, prefabricated closet.

Another object of this invention is to provide a closet construction which is fabricated at one location and installed at a building site.

Another object of this invention is to provide a modular closet which reduces the costs of construction.

Yet another object of this invention is to provide a prefabricated closet which has a stronger, damage resistant interior.

Another object of the present invention is to provide a prefabricated closet having shelving supports.

Still another object of this invention is to provide a modular closet having a simple, non-mechanical ventilation system.

Another object of the present invention is to provide a prefabricated closet having a lighting assembly prewired therein so that only one electrical field connection is required.

In one form thereof the present invention discloses a prefabricated closet assembly for installation in conjunction with a structure. The closet assembly has a base plate which provides a closet floor and an integral enclosure having a top, front, rear, and side walls so that the enclosure and base plate define a closet volume. The enclosure has an interior surface and an exterior surface and contains an opening to provide access to the closet volume. The closet assembly also has a connection means, integral with and protruding from the exterior surface of the enclosure to facilitate the attachment of the modular closet to the structure and the attachment of a wall surface to the enclosure.

In another form thereof, the present invention discloses a prefabricated closet for installation in conjunction with a structure. The closet has an enclosure defining a closet volume. The enclosure has an interior surface and an exterior surface and contains an opening to provide access to the closet volume. The closet also has a frame means, on the exterior surface of the enclosure, to facilitate attaching the modular closet to the structure and attaching a wall surface to the enclosure.

Another object of the present invention is to provide a simple and efficient method of installing a prefabricated closet unit.

In the present invention there is provided a method for installing a prefabricated modular closet in a structure comprising the following steps. A base plate is affixed at a selected position on the floor of the structure. An integral enclosure having a ceiling, a rear wall, opposite side walls, and a front wall containing an opening therein is provided. The integral enclosure is positioned relative to the base plate so that the integral enclosure and base plate define a closet volume. The integral enclosure and base plate are then affixed to the structure.

BRIEF DESCRIPTION OF THE DRAWINGS

The invention will now be disclosed, by way of example, with reference to a specific embodiments thereof illustrated in the accompanying drawings, in which.

DETAILED DESCRIPTION OF SPECIFIC EMBODIMENTS

Figure 1:
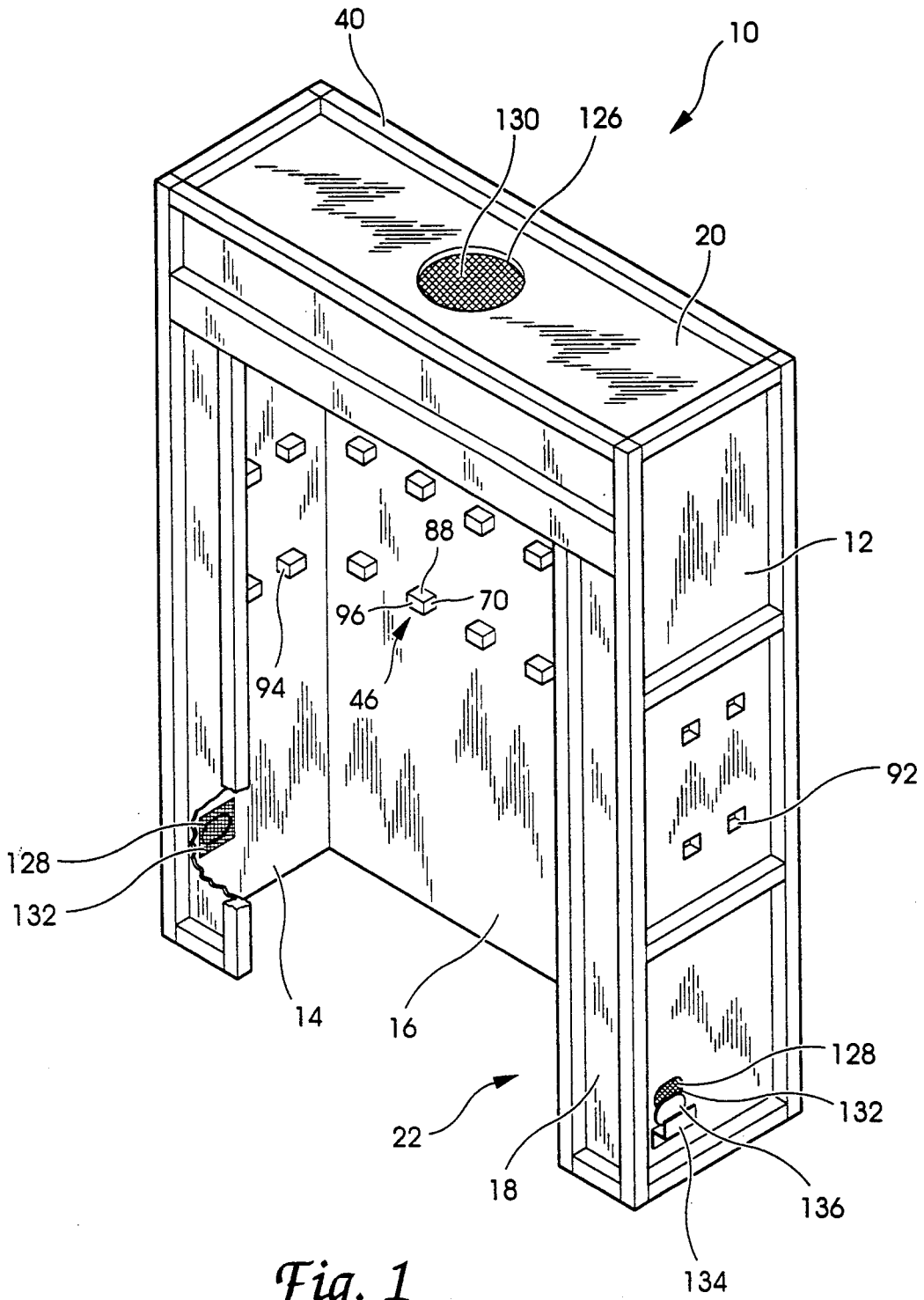
FIG. 1 illustrates a perspective view partially broken away in a section of a specific embodiment of the modular closet in accordance with the invention.
Figure 2:
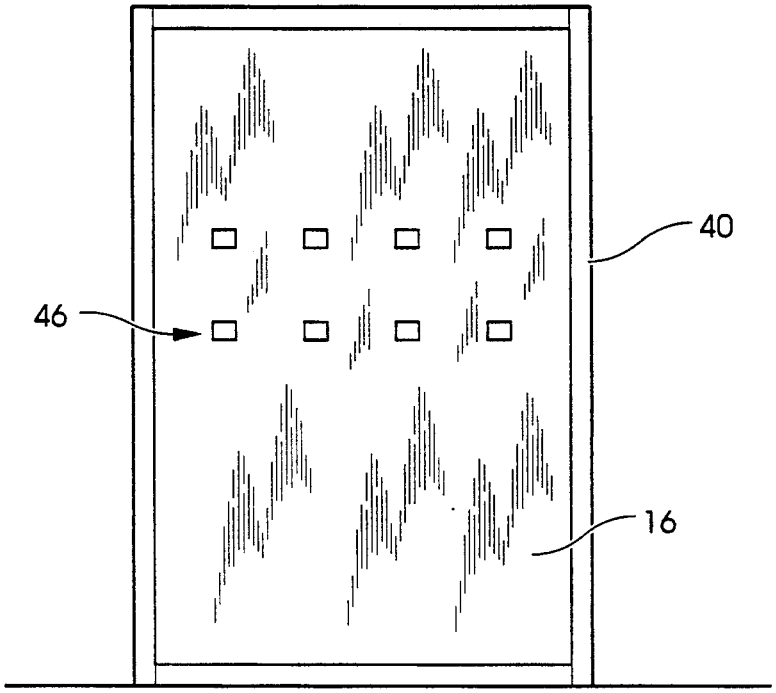
FIG. 2 illustrates a rear view of the modular closet of FIG. 1.

Referring now in detail to the drawings, there is shown a prefabricated closet, generally indicated as 10, (FIG. 1). The closet 10 has a first sidewall 12, a second sidewall 14, a back wall 16, a front wall 18, and a ceiling 20. The front wall 18 contains an entrance opening 22 therein so as to provide access into and out of the closet. The first sidewall 12, second sidewall 14, back wall 16, front wall 18 and ceiling 20 are formed as a single integral unit. The single integral unit may be made of molded acrylic or some other similar type of material suitable for molding and having a durable, smooth finish. This molded acrylic unit is reinforced by a laminate fiberglass reinforcement. Alternatively, the closet 10 can be structured so that walls 12, 14, 16, 18, and ceiling 20 each consist of an independent panel. These panels can be assembled at the building site to form the integral unit.

The closet 10 has framing 40 attached to the exterior surface thereof. Framing 40 serves as a location for the attachment of drywall or other wall finishing material to the exterior surface of the closet 10. Preferably, the framing 40 is made of 2"×2" wood furring strips and is affixed to the peripheral edges of sidewall 12, sidewall 14, backwall 16, frontwall 18 and ceiling 20 of closet 10 as shown in the drawings.

Figure 3:
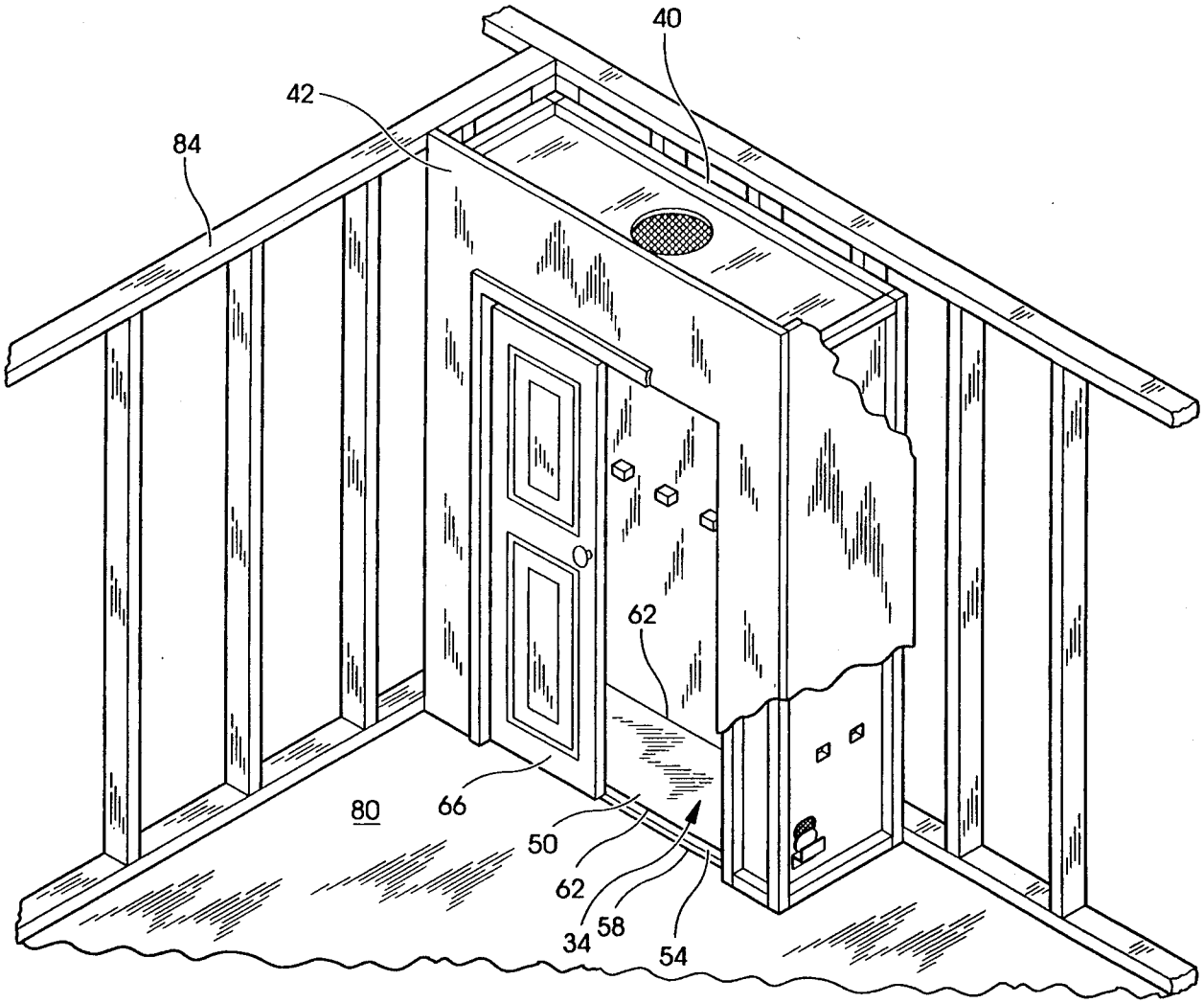
FIG. 3 illustrates a perspective view of the modular closet of the present invention installed in a structure and having partially applied drywall and door assembly.

As can be seen in FIG. 3, a base, generally indicated as 34, is secured to floor 80 of a structure at the location where the builder desires to install the closet 10. The preferred method of attaching base 34 to floor 80 is by screwing base 34 to floor 80 at lip 58 of base 34 so that the heads of the screws are covered by the bottom edge of closet 10 when closet 10 is placed over the base 34. When the base 34 is secured to the floor 80, closet 10 is placed over base 34. Closet 10 may then be properly secured to floor 80. Closet 10 is also properly secured to the frame work of the building 84 by any suitable means such as, for example, nailing.

The base 34 consists of a rectangular member 50 having four edges 62 (only two edges 62 are shown in FIG. 3), and four sidewalls 54 (only the front sidewall 54 is shown in FIG. 3). Each sidewall 54 extends downward from its respective edge 62. It can be seen where the rectangular member 50 and the sidewalls 54 together define a volume. A lip 58 is connected to the bottom edge of said sidewalls 54 and extends in a direction outward of the sides 54 and generally parallel to upper surface 50. Ribs (not shown), preferably consisting of strips of lumber having a thickness equal to or slightly less than the height of side walls 54, are mounted in the volume of base 34 so as to provide a sufficient support to accommodate the weight demands of base 34. The base 34 is of the same general shape as the width and depth of the closet 10. Upper member 50 of base 34 is proportioned to be slightly smaller that the width and depth of the closet 10 so that when the closet 10 is placed over the base 34, the interior surface of the first sidewall 12, second sidewall 14, backwall 16, and frontwall 18 abuts the exterior surface of sidewalls 54 and the bottom edge of closet 10 rests on lip 58.

As shown in FIG. 3, drywall 42 can be attached to the exterior surface of closet 10 by affixing it by nailing or screwing to framing 40. Framing 40 provides members to receive the nails or screws which pass through the drywall. Furthermore, a conventional closet door 66 can be hung in opening 22 of closet 10.

Closet 10 can also be equipped with any number of devices to provide shelving within the volume of the closet. This feature adds to the versatility of the closet. As shown in FIG. 1, a plurality of generally rectangular shelf brackets 46 are provided in closet 10. The shelf brackets 46 of the present invention are located intermediate the ceiling 20 and base 34. Each bracket 46 has an upper surface 88 a lower surface 92, a first sidewall 90, a second sidewall 94, and a bottom surface 96. Brackets 46 are aligned in a side-by-side manner within the closet volume so that when a shelf (not shown) is placed on the upper surface 88 of brackets 46 so aligned, that said shelf is parallel to ceiling 20 and base 34.

Figure 4:
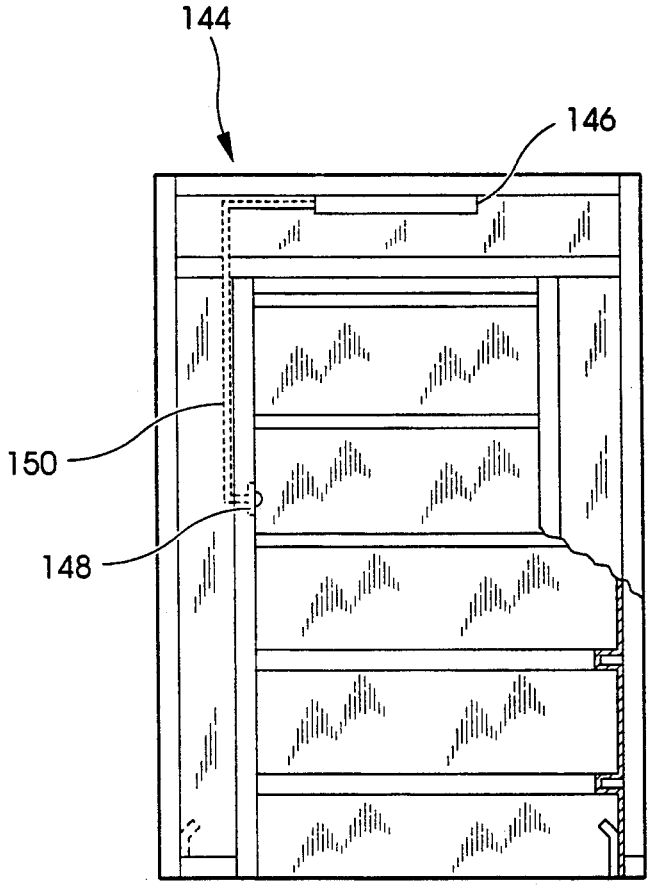
FIG. 4 illustrates a front view, partially broken away in a section, of another specific embodiment of the modular closet of the present invention wherein a lighting assembly is included.

FIG. 4 illustrates alternate shelf supports rather than being a series of individual members, the shelf support is continuous. The shelf is placed on the upper surface of the shelf support.

Furthermore, closet 10 can be provided with a prewired lighting assembly 144. The lighting assembly 144 shown in FIG. 4 consists of a lighting fixture 146, a switch 148, and a wire 150 connecting lighting fixture 146 and switch 148. Lighting fixture 146 is contained in the closet volume. Lighting assembly 144 is installed in closet 1 during the construction of closet 10 and is prewired so that only one electrical field connection is required when closet 10 is installed at a building site. In operation, the light is illuminated when the closet door is open. The light is not illuminated when the closet door is closed.

Additionally, closet 10 can be provided with a vent system comprising a plurality of apertures contained in closet 10 to allow a flow of air through the volume of closet 10. In FIG. 1 there is provided a vent aperture 126 located in ceiling 20, a vent aperture 128 located in sidewall 12, and a corresponding vent aperture 128 located in sidewall 14. Vent aperture 126 is provided with a screen 130. Vent aperture 128 is provided with a screen 132. In the present invention, the vent system is also provided with deodorizer holder 134 and deodorizer 136. Deodorizer holder 134 is affixed to the exterior surface of sidewall 12 below vent hole 128 so that deodorizer 136 is adjacent to vent aperture 128. Air circulating through vent aperture 128 picks up the scent of deodorizer 136. Thus, the closet always presents the desired odor.

Figure 5:
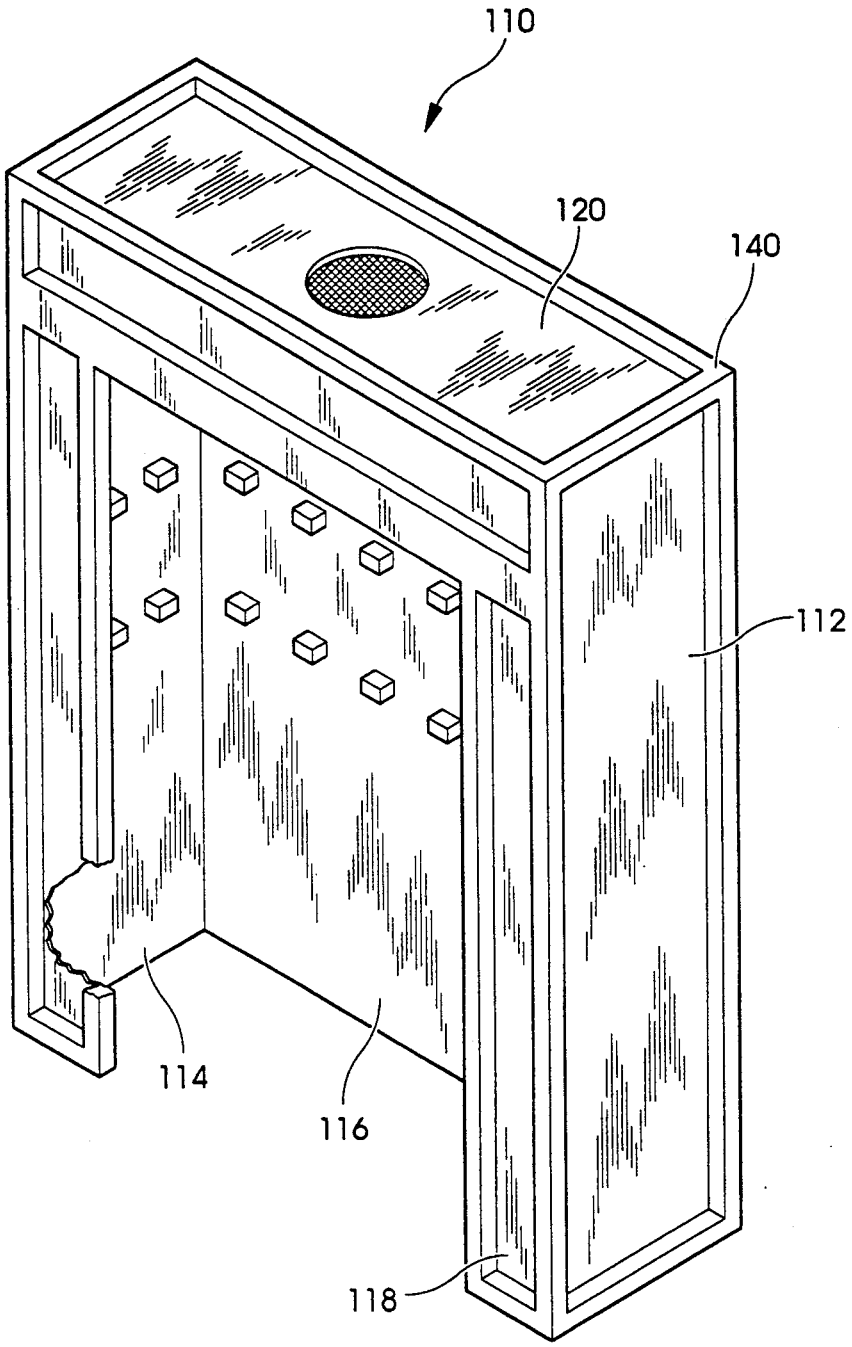
FIG. 5 illustrates a perspective view, partially broken away in a section, of still another specific embodiment of the modular closet in accordance with the invention.

FIG. 5 shows another specific embodiment of the prefabricated closet of the present invention. The prefabricated closet of FIG. 5 is generally indicated as 110. Closet 110 has a first sidewall 112, a second sidewall 114, a backwall 116, a front wall 118 and a ceiling 120. Additionally, closet 110 has integral framing sections 140. In closet 110, the first sidewall 112, second sidewall 114, back wall 116, front wall 118, ceiling 120 and framing section 140 are formed via a dual laminate vacuum form process or an injection molding process as a single integral unit. The single integral unit may be made of molded fiberglass, polypropylene, acrylic, or some other similar type of material suitable for molding and having a smooth, durable finish. The molded unit is typically reinforced by a fiber reinforced plastic reinforcing material. The reinforcement may be applied by a chop shot process.

Although applicant has shown and described a prefabricated modular closet for installation in conjunction with a structure, it will be understood that certain modifications, and variations are within the scope of the present invention.

I claim:

1. A closet assembly for installation in conjunction with a structure, which includes a floor, comprising:

(a) a prefabricated closet, comprising an enclosure having top, front, rear, and side walls so that said enclosure and a base define a closet volume wherein items can be stored, said enclosure having an interior surface and an exterior surface, said enclosure containing an opening to provide access to the closet volume so that the items can be retrieved or stored in the closet volume, wherein said front walls extend inwardly towards each other from said side walls with said opening located between said front walls; and an exterior frame protruding from the exterior surface of said enclosure, for facilitating the attachment of said closet assembly to said structure and the attachment of a wall surface to said enclosure after said closet assembly has been attached to the structure, wherein said exterior frame protrudes at least partially from said front walls;

a support member running between said side walls within said enclosure; and, (b) a wall surface panel for exteriorly covering said exterior frame in front of said front walls of said enclosure, wherein said wall surface panel is affixed to said exterior frame after said prefabricated closet has been attached to the structure.

2. The closet assembly of claim 1 wherein said enclosure is formed as a single integral unit of a moldable material having a smooth surface so that said interior surface of said enclosure is smooth.

3. The closet assembly of claim 2 wherein said moldable material is fiber glass.

4. The closet assembly of claim 1 wherein said exterior frame comprises wooden furring attached to the perimeter of said top, front, rear, and side walls.

5. The closet assembly of claim 1 further comprising a bracket located within said enclosure for supporting said support member.

6. The closet assembly of claim 1 and further comprising a base member securable to the floor of the structure, said base member further defining said closet volume.

7. A method of installing a prefabricated modular closet in a structure which includes a floor, comprising the steps of:

providing a prefabricated modular closet comprising (a) an enclosure having a ceiling, a rear wall, opposite sidewalls, and a front wall, said front wall containing an opening, a support member running between said sidewalls, and (b) an exterior frame protruding form said enclosure;

positioning said prefabricated modular closet in a predetermined location on the floor of the structure;

affixing said prefabricated modular closet to said floor of the structure; and thereafter affixing wall covering to portions of said exterior frame exteriorly covering said exterior frame in front of said front walls of said enclosure.

8. The method of claim 7 further comprising the step of mounting a door within said opening contained in said front wall.

9. The method of claim 7 and further comprising the step of affixing a base member to the floor of the structure, said base member further defining said closet volume.

* * * * *

UNITED STATES PATENT AND TRADEMARK OFFICE

CERTIFICATE OF CORRECTION

PATENT NO. : 5,319,903

DATED : June 14, 1994

INVENTOR(S) : Phillip R. Holland

It is certified that error appears in the above-indentified patent and that said Letters Patent is hereby corrected as shown below:

Column 4, line 9 "1" -- should read "10"

Column 6, line 13 "form" -- should read "from"

Signed and Sealed this

Eighteenth Day of October, 1994

*Attest:*

*Attesting Officer*

Bruce Lehman

BRUCE LEHMAN

*Commissioner of Patents and Trademarks*